United States Patent [19]

Paulucci

[11] 4,308,952

[45] Jan. 5, 1982

[54] CONTAINER ASSEMBLY

[75] Inventor: Jeno F. Paulucci, Duluth, Minn.

[73] Assignee: Jeno's, Inc., Duluth, Minn.

[21] Appl. No.: 115,799

[22] Filed: Jan. 28, 1980

[51] Int. Cl.[3] ..... B65D 21/02

[52] U.S. Cl. ..... 206/216; 206/499; 206/501; 206/503; 206/516; 206/821; 220/23.6

[58] Field of Search ..... 206/216, 219, 499, 501, 206/503, 508, 509, 516, 519, 520, 257, 821, 828; 220/23, 23.6

[56] References Cited

U.S. PATENT DOCUMENTS

| | | | |
|---|---|---|---|
| 2,766,891 | 10/1956 | Elzer | 220/410 |
| 3,317,087 | 5/1967 | Landis | 220/23.6 |
| 3,654,875 | 4/1972 | Vils | 206/561 |
| 3,885,672 | 5/1975 | Westenrieder | 206/503 |

FOREIGN PATENT DOCUMENTS

| | | | |
|---|---|---|---|
| 1271249 | 7/1961 | France | 220/23 |

*Primary Examiner*—Herbert F. Ross

*Attorney, Agent, or Firm*—Hume, Clement, Brinks, Willian & Olds, Ltd.

[57] ABSTRACT

A commodity can assembly comprising upper and lower cylindrical cans having beads around opposed ends which are releasably gripped by a storage unit connector. The connector is molded of stiff but slightly resilient plastic and includes a cylindrical wall having annular lips inside it which grip the can beads. Between the lips a spaced pair of inwardly extending shoulders serve as stop for the can ends and define a compartment between them in which a third commodity is stored for marketing.

3 Claims, 4 Drawing Figures

CONTAINER ASSEMBLY

FIELD OF THE INVENTION

This invention is in the field of containers. It relates particularly to food containers.

BACKGROUND OF THE INVENTION

It is well known in the container or packaging arts to join two cylindrical containers at their end for marketing or use in this fashion. The Hothersall U.S. Pat. No. 2,249,764, discloses an exemplary assembly, illustrating a pair of tubular cans containing explosives placed end to end and releasably interconnected by a removal ring. The Landis U.S. Pat. No. 3,317,087 discloses another exemplary assembly wherein cans snap into opposite ends of plastic holder ring. There are others too numerous to mention. What such assemblies do not do is join two commodity cans together in such a way that yet another product or commodity can be packaged between them and marketed with them.

SUMMARY OF THE INVENTION

An object of the present invention is to provide a new and improved commodity can assembly. Another object is to provide an assembly of the aforedescribed character wherein three separate but related products are marketed in a two can assembly. Still another object is to provide an assembly wherein a third product is removably stored for marketing between cans containing first and second products. A further object is to provide an assembly wherein two cans are assembled with a storage unit connector embodying features of the invention.

The foregoing and other objects are realized in accord with the invention by providing a can assembly comprising a first cylindrical commodity can, a second cylindrical commodity can, and a cylindrical storage unit connector between them. The cans are conventional food cans or the like, preferrably containing two separate ingredients for a single food dish. The cans are the same diameter, one usually being longer than the other and thus larger.

Each of the cans has a conventional bead formed around each end where the bottom of the can is attached to the cylindrical portion of the can. The storage unit connector embodying feature of the invention is designed to releasably grip the beads at opposed ends of the two cans placed in longitudinal alignment with each other. The connector is fabricated from a stiff but slightly resilient plastic which permits the opposite ends of the cans to be press fit past a retaining lip on the connector and held in assembly with the connector by the resilient force of the connector and the lip cooperating with the bead.

The connector is constructed with upper and lower inwardly extending shoulders formed from its outer wall. These shoulders are spaced apart and form a deep channel extending around the interior of the connector. According to the invention a flexible packet containing a third commodity is inserted into this channel by deflecting the generally rectangular packet at its corners and inserting them into the channel so that the packet is held snugly and securely within the connector ring.

After the packet has been inserted in the connector ring, each of the cans is press fit into an opposite end of the ring in the matter hereinbefore described. The resultant assembly is marketed in this fashion, preferrably as an assembly of three food products which are to be ingredients in the same food dish.

BRIEF DESCRIPTION OF THE DRAWING

The invention, including its construction and method of operation, together with additional objects and advantages thereof, is illustrated more or less diagrammatically in the drawing, in which.

DESCRIPTION OF THE PREFERRED EMBODIMENT

Figure 1:
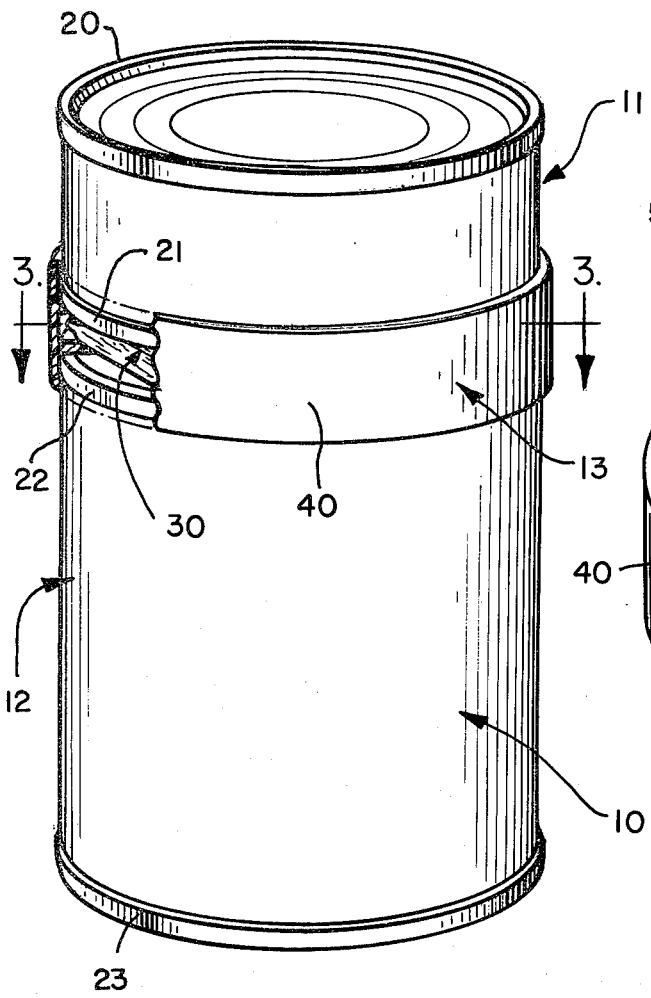
FIG. 1 is a perspective view of an improved commodity can assembly embodying features of the present invention.

Referring now to the drawing, and particularly to FIG. 1, a commodity can assembly embodying features of the present invention is shown generally at 10. The commodity can assembly includes an upper cylindrical commodity can 11 and a lower cylindrical commodity can 12 releasably connected by a storage unit connector 13.

The upper can 11 is cylindrical and has a conventional upper bead 20 and lower bead 21. In the preferred embodiment of the invention the upper can 11 is normally a relatively "short" can, of the type which might be expected to contain packed tuna, for example.

The lower can 12 is a longer can in the present illustration. It is shown as being approximately three times as long as the upper can 11 but this is merely exemplary and its length might vary widely within marketing demand. The lower can 12 has a conventional upper bead 22 and lower bead 23 extending around it.

Releasably interconnecting the cans 11 and 12 according to the invention is the storage unit connector 13 which grips the lower bead 21 on the can 11 and the upper bead 22 on the can 12 in press fit, releasable relationship. The storage unit connector 13 retains a third commodity packet 30 within its confines in a manner which is illustrated in FIG. 3.

Figure 2:
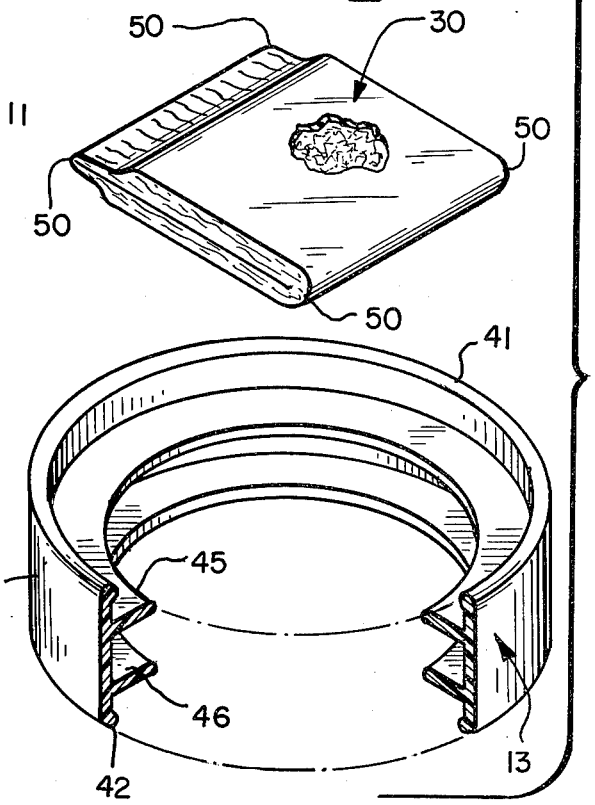
FIG. 2 is an exploded view of the storage unit connector embodying features of the invention, with the third commodity normally stored in it and shown in separated relationships.

Turning to FIG. 2 the construction of the storage unit connector 13 and the manner in which the packet 30 is inserted, is illustrated. The storage unit connector 13, illustrated in segmented and exploded relationship in FIG. 2, comprises a plastic ring molded in a single piece. The plastic utilized is any one of a number of conventional, relatively rigid, yet somewhat resilient plastic materials such as Delrin. It is molded in an annular wall 40 with an inwardly extending annular lip 41 formed around its upper edge and a corresponding inwardly extending annular lip 42 formed around its lower annular edge. Between the lips 41 and 42 a pair of longitudinally spaced shoulders 45 and 46 are formed, extending inwardly from the cylindrical wall 40 of the ring. The shoulders are spaced apart and extended inwardly approximately one-half ($\frac{1}{2}$) inch from the wall 40.

Figure 3:
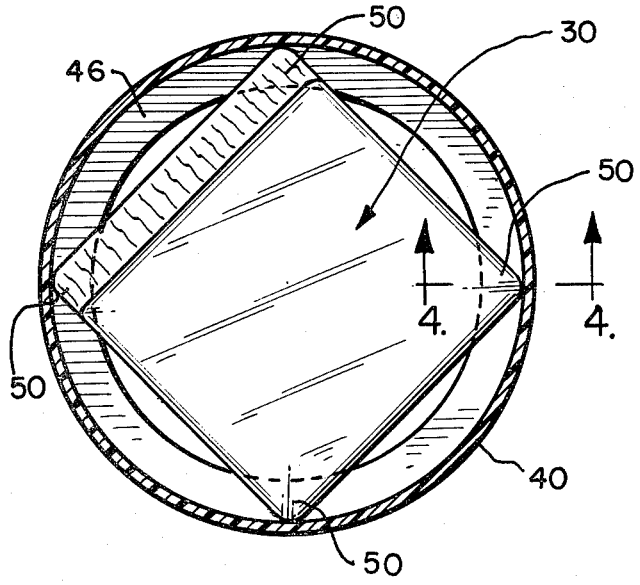
FIG. 3 is a view taken along line 3—3 of FIG. 1.

The dimensions of the packet 30, which is preferrably square in plan, as illustrated in FIGS. 2 and 3, are such that the measurement diagonally of the packet corresponds substantially to the inside diameter of the wall 40. The packet 30 is inserted between the shoulders 45 and 46 of the connector 13 by bending or folding the package so that its four corners 50 extend between the shoulders 45 and 46 and releasably, but snugly and securely, hold the packet in the storage unit connector.

Figure 4:
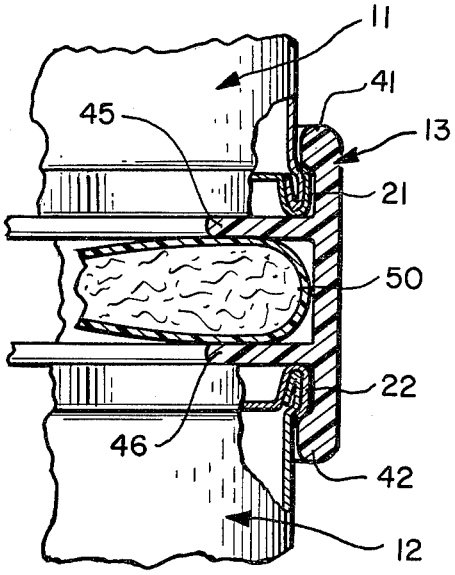
FIG. 4 is an enlarged sectional view taken along line 4—4 of FIG. 3.

As best seen now in FIG. 4, the upper can 11 and the lower can 12 are inserted into the storage unit connector 13 once the packet 50 has been mounted in place. The annular lip 41 around the connector 13 snugly grips the bead 21 around the lower periphery of the can 11. In turn, the lip rim 42 on the lower end of the connector 13 snugly grips the bead 22 around the upper end and of the lower can 12.

In this assembled relationship the cans 11 and 12 are held securely together, yet can be separated by twisting them away from the storage unit 13. At this time the packet 50 can easily be removed from the storage unit connector 13 by bending it to cause the corners 50 of the packet to withdraw from the channel formed by the shoulders 45 and 46. While the assembly is maintained, however, the packet 50 is locked in a completely protected place between the cans 11 and 12.

While the embodiment described herein is at present considered to be preferred, it is understood that various modifications and improvements may be made therein, and it is intended to cover in the appended claims all such modification and improvements as fall within the true spirit and scope of the invention.

What is desired to be claimed and secured by Letters Patent of the United States is:

1. An assembly, comprising:

(a) a first cylindrical commodity can having a bead extending around a lower end, (b) a second cylindrical commodity can having a bead extending around an upper end, (c) a storage unit connector between said first and second cans, (d) said connector being fabricated of a relatively rigid plastic having some resiliency, (e) said connector including a cylindrical wall having upper and lower edges around which inwardly extending lips are formed, (f) a pair of longitudinal spaced shoulders formed inwardly from said wall and defining an annular channel therebetween, (g) said bead of said first can seating against one of said shoulders and said bead of said second can seating against the other of said shoulders whereby said lips overlie corresponding beads and retain said first and second cans in assembly with said connector, and (h) a commodity package seated in said channel between said shoulders.

2. The assembly of claim 1 further characterized in that:

(a) said commodity package is flexible whereby it is folded to be inserted between said shoulders and removed therefrom.

3. The assembly of claim 2 further characterized in that:

(a) said cans and said connector have substantially identical diameters.

* * * * *

UNITED STATES PATENT AND TRADEMARK OFFICE

CERTIFICATE OF CORRECTION

PATENT NO. : 4,308,952
DATED : January 5, 1982
INVENTOR(S) : Jeno F. Paulucci

It is certified that error appears in the above-identified patent and that said Letters Patent are hereby corrected as shown below:

Column 4, line 12, please delete "longitudinal" and substitute therefor --longitudinally--.

Signed and Sealed this

*Twenty-seventh* Day of *July 1982*

[SEAL]

*Attest:*

GERALD J. MOSSINGHOFF

*Attesting Officer*

*Commissioner of Patents and Trademarks*